US011692311B2

(12) United States Patent
Raines

(10) Patent No.: US 11,692,311 B2
(45) Date of Patent: Jul. 4, 2023

(54) WEB AIR THREADING SYSTEM AND METHODS OF USE

(71) Applicant: David Drew Raines, Flowery Branch, GA (US)

(72) Inventor: David Drew Raines, Flowery Branch, GA (US)

( * ) Notice: Subject to any disclaimer, the term of this patent is extended or adjusted under 35 U.S.C. 154(b) by 377 days.

(21) Appl. No.: 17/016,267

(22) Filed: Sep. 9, 2020

(65) Prior Publication Data

US 2021/0324581 A1 Oct. 21, 2021

Related U.S. Application Data

(60) Provisional application No. 63/012,801, filed on Apr. 20, 2020.

(51) Int. Cl.
*D21G 9/00* (2006.01)
*B65H 29/24* (2006.01)

(52) U.S. Cl.
CPC ..... *D21G 9/0063* (2013.01); *B65H 29/245* (2013.01); *B65H 2801/84* (2013.01)

(58) Field of Classification Search
CPC ..... D21G 9/0063; B65H 29/245; B65H 2406/122; B65H 2801/84; B65H 2301/522; B65H 20/14
See application file for complete search history.

(56) References Cited

U.S. PATENT DOCUMENTS 963,969 A * 7/1910 Williams ..... B05B 1/24 239/582.1
2,052,869 A 9/1936 Coanda
3,999,696 A 12/1976 Reba et al.
4,384,666 A * 5/1983 Koponen ..... F26B 13/104 242/615.11

(Continued)

FOREIGN PATENT DOCUMENTS

EP 0423066 A1 10/1989

OTHER PUBLICATIONS

Merriam-Webster, proximate, date retrieved: Jan. 9, 2023, url: https://www.merriam-webster.com/dictionary/proximate (Year: 2023).*

(Continued)

*Primary Examiner* — Eric Hug
*Assistant Examiner* — Elisa H Vera
(74) *Attorney, Agent, or Firm* — Mathew L. Grell; Grell & Watson Patent Attorneys LLC

(57) ABSTRACT

An air nozzle apparatus that includes an air orifice and a nozzle housing, said nozzle housing configured as u-shaped having a first elongated sidewall, a second elongated sidewall, and a third curved sidewall formed continuous with said first elongated sidewall and said second elongated sidewall to form a channel having an open end opposite said third curved sidewall, said air orifice positioned centered in said channel and proximate a base of said third sidewall facing said open end, wherein said first elongated sidewall, said second elongated sidewall, and said third curved side- (Continued)

wall are configured having an arched top surface, and, thus, functions to optimize the Coanda effect to position and convey the paper web through an air threading chute to thread a paper web from the end of the drying step through the dry-end to the paper winding step.

12 Claims, 7 Drawing Sheets

(56) References Cited

U.S. PATENT DOCUMENTS

| | | | |
|---|---|---|---|
| 4,813,460 | A | 3/1989 | Van Bogaert et al. |
| 5,526,850 | A | 6/1996 | Sora et al. |
| 2016/0067911 | A1 | 3/2016 | Cavins et al. |

OTHER PUBLICATIONS

Home Stratosphere, 30 Types of Architectural Arches (with Illustrated Diagrams), Aug. 14, 2019, Home Stratosphere (Year: 2019).*
International Search Report and Written Opinion dated Dec. 10, 2020 for corresponding International Application No. PCT/US2020/050010.

* cited by examiner

WEB AIR THREADING SYSTEM AND METHODS OF USE

CROSS-REFERENCE TO RELATED APPLICATIONS

To the full extent permitted by law, the present United States Non-provisional Patent Application hereby claims priority to and the full benefit of, U.S. Provisional Application No. 63/012,801, filed on Apr. 20, 2020, entitled "ADVANCED WEB AIR THREADING SYSTEM WITH NOZZLE AND SHAPEABLE SUBSTRATE TO PROVIDE AN EXTENSION", which is incorporated by reference herein in its entirety.

FIELD OF THE DISCLOSURE

The present disclosure is directed to a paper mill threading system to thread a paper tail to start the paper process. More specifically, the present disclosure is directed to a web air threading system that is convertible between seating and lounging and having a minimally sized form factor.

BACKGROUND

A paper-making machine is an industrial process used in the pulp and paper industry to create large volumes of paper at high speed. Modern paper-making machines include three main sections: a wet end forming section creates a continuously moving wet mat of fiber, a wet press and/or drying section removes water from the wet mat of fiber to produce a dried paper web, and a dry-end section which may include sheet handling, calendaring, and winding steps. Within the dry-end section the calendar system thereafter consists of two or more rolls used to roll and apply pressure to the passing paper. Calenders are used to make the paper surface extra smooth and glossy, and set a uniform thickness to the paper.

Within a papermaking process the sheet being produced must be passed through the machine commonly terminating at a winding step. The wound web may then be finished or converted in subsequent unit operations after its initial production on a paper machine. Periodically, the web or sheet breaks within the papermaking process and must be rethreaded in order to reestablish winding of the full sheet. This is accomplished by cutting a small section of the sheet using a pick or water nozzle to cut a continuous, small section of the sheet, feeding this small section to the winding device, then widening the sheet to full width by indexing the pick/water nozzle in order to restore full width winding of the web.

Prior to the 1960's, the small continuous tail was often thrown by hand through the machine, usually through a series of nips, until it was finally thrown to the final winding device. Such an approach carried significant safety and operational challenges as an individual's hands were often in close proximity to the nip. Additionally, higher paper machine speeds made it increasingly difficult for a human to throw the sheet fast enough to approach the speed of the machine. Another early approach for rethreading entailed using rope runs to carry the small tail to the winding step. Again, this approach presented considerable safety issues to operators via pinch points, ingoing nips, and the risk the ropes would periodically break injuring an operator.

Various inventions were created during the 1960's and 1970's utilizing chutes with air nozzles to convey the small continuous section of sheet through sections of the machine and/or to the winding device. These inventions utilized the Coanda Effect, which asserts that air exiting a small slit or nozzle tends to follow an adjacent straight or curved surface and generates a low pressure region around itself by pulling in nearby ambient air, and thus pulls the paper web along the chute surface with the exiting air. Moreover, these inventions utilized the Bernoulli's Principle, which states that an increase in the speed of a fluid occurs simultaneously with a decrease in static pressure. Here a low pressure occurs above and around the air exiting a small slit or nozzle drawing or pulling the paper web toward the nozzle.

One prior approach of an air threading system utilizes the Coanda effect/Bernoulli principle to guide a small web section or section of paper sheet through different parts of a paper machine via nozzles and chutes. Such air threading system nozzles have included ⅛ inch tubing or larger sized pipe with an end cap and a small aperture therein are inserted proximate a sidewall of the chute and bent to exhaust compressed air in the direction of the flow of the paper web. One disadvantage or drawback to these approaches is that, these air threading systems having the continuous section of fibrous web, commonly referred to as the threading tail, fall out of one or more threading chutes before it reaches its intended target. This challenge is often made more difficult when the path to the target is not straight, such as the path around a calender stack. Another disadvantage or drawback to these approaches is that, these air threading systems pull the fibrous web into the highest velocity air causing the air stream to shred the paper web like confetti. Moreover, the task threading has been made further difficult by lighter, weaker, and structured sheets such as retail tissue, toilet paper, and towel that are more flexible and therefore more difficult to feed through the paper making process.

Therefore, it is readily apparent that there is a recognizable unmet need for a web air threading system and methods of use that may be configured to address at least some aspects of the problems discussed above common to rethreading the paper web via nozzles and chutes.

SUMMARY

Briefly described, in an example embodiment, the present disclosure may overcome the above-mentioned disadvantages and may meet the recognized need for a web paper air threading system and methods of use, utilizing an air nozzle apparatus that includes an air orifice and a nozzle housing, said nozzle housing configured as u-shaped having a first elongated sidewall, a second elongated sidewall, and a third curved sidewall formed continuous with said first elongated sidewall and said second elongated sidewall to form a channel having an open end opposite said third curved sidewall, said air orifice positioned centered in said channel and proximate a base of said third sidewall facing said open end, wherein said first elongated sidewall, said second elongated sidewall, and said third curved sidewall are configured having an arched top surface, and, thus, functions to utilize the Coanda effect to position and convey the paper web through air threading chutes and delivering the thread tail to the final winding step.

Accordingly, in one aspect, the present disclosure utilizes compressed air to exploit the Bernoulli Theorem and Coanda effect to guide a small continuous portion of a fibrous web through sections of a papermaking process including conveyance to a winding device. The described disclosure is unique, however, in that the construction of the nozzles themselves including the geometry of the nozzle bodies, nozzle parameters, nozzle orifice geometry, and nozzle positions, are all tailored within the air threader design to amplify and optimize the Coanda effect while using less compressed air to guide a fibrous web. The combined result of these optimized parameters, thereby optimizing the Coanda effect, provides an air threading system that will hold and guide even the most delicate web tail within the guide chutes more effectively than any previous embodiments.

As described, there are three key nozzle design elements that serve to optimize the Coanda effect thereby creating a superior web air threading system compared to previous embodiments.

Accordingly, in another aspect, the present disclosure may include a threading system to guide a small continuous section of paper web through one or more threading chutes, the system includes a side wall of the one or more threading chutes, at least one nozzle body affixed to the side wall, the at least one nozzle body having a rounded top surface beginning from a leading edge positioned proximate the side wall, a trailing edge configured raised above the side wall, and at least one side extends from the trailing edge to the side wall, at least one aperture formed therethrough the at least one side, and thus, to provide a nozzle body and aperture configuration to generate an optimal Coanda effect in a chute in order to guide a small continuous section of the web paper through the guide chutes while holding the tail flat, keep it within the guide chutes during the tail feed process, prevent damage to the web as it is fed though the chutes, while using less compressed air consumption to perform the task.

Accordingly, in another aspect, the present disclosure may provide, a wide nozzle body including radiuses, angles, or slopes to form the sidewalls around the nozzle orifice, and abruptly drops off at the conclusion or end edge of the radiused or elevated surface, and is in physical contact with the side wall along all of the bottom, side, and end edges of the nozzle via side and end sections or consist of a base or bottom. By configuring the nozzle body geometry in this fashion, a wide low pressure region above and around the nozzle body is generated providing a significant low pressure zone in both size and magnitude compared to other previous embodiments utilizing a pipe, slit, aperture, or tube end.

Accordingly, in another aspect, the present disclosure of the nozzle body geometry not only assists in amplifying the Coanda effect generated by the air exiting the nozzle but is further amplified by the web traveling over and past it, as the web itself drags more air out of the exit pocket further decreasing the static pressure in the area of the nozzle orifice which in turn further assists in holding the tail within the guide chutes and proximate the side wall configured with a plurality of nozzle bodies. Moreover, the height of the nozzle body sidewalls create supports for the paper web, which provide a space or cushion between the web and the nozzle, and thus reduce or prevent tearing, snapping, or shredding of the paper web P.

Accordingly, in another aspect, the present disclosure of the nozzle orifice or aperture may be positioned as close as possible to the sidewall of the chute so as to a) increase the propensity of the air to follow the wall and b) maximize the distance between the nozzle and the high velocity air flow exiting the nozzle orifice so as to maximize the size and magnitude of the low pressure region created by the nozzle body geometry.

All together the combined nozzle architecture of the present disclosure including geometries of the nozzle body and nozzle orifice or aperture configuration and position not only amplifies the Coanda effect in the chutes, they also serve to insure the straight flow pattern through the guide chutes compared to tubing or pipes used in the vast majority of other embodiments of the device currently in use. The combined benefit of the present disclosure is its ability to hold the tail flat, keep it within the guide chutes during the tail feed process, prevent damage to the web as it is fed though the chutes, while using less compressed air consumption to perform the task.

Accordingly, in another aspect, the present disclosure may include any and all dimensional relationships, to include variations in size, material, shape, form, position, function and manner of operation, assembly and use, are intended to be encompassed by the present disclosure.

In an exemplary embodiment of the air threading apparatus may include an air orifice and a nozzle housing, the nozzle housing configured as u-shaped having a first elongated sidewall, a second elongated sidewall, and a third curved sidewall formed continuous with the first elongated sidewall and the second elongated sidewall to form a channel having an open end opposite the third curved sidewall, the air orifice positioned centered in the channel and proximate a base of the third sidewall facing the open end, wherein the first elongated sidewall, the second elongated sidewall, and the third curved sidewall are configured having an arched top surface.

In another exemplary embodiment of the air threading apparatus may include a nozzle housing, the nozzle housing configured having a plurality of u-shapes, each u-shape having a first elongated sidewall, a second elongated sidewall, and a third curved sidewall formed continuous with the first elongated sidewall and the second elongated sidewall to form a channel having an open end opposite the third curved sidewall, the each u-shape having an air orifice positioned centered in the channel and proximate a base of the third sidewall facing the open end, wherein the first elongated sidewall, the second elongated sidewall, and the third curved sidewall of the each u-shape are configured having an arched top surface.

In another exemplary embodiment of the air threading system to guide a small continuous section of web paper, may include a sidewall of an air threading chute; and a plurality of air nozzles, each the air nozzle having an air orifice and a nozzle housing, the nozzle housing configured as u-shaped having a first elongated sidewall, a second elongated sidewall, and a third curved sidewall formed continuous with the first elongated sidewall and the second elongated sidewall to form a channel having an open end opposite the third curved sidewall, the air orifice positioned centered in the channel and proximate a base of the third sidewall facing the open end, wherein the first elongated sidewall, the second elongated sidewall, and the third curved sidewall are configured having an arched top surface, the sidewall having the plurality of the air nozzles positioned linearly there along the sidewall.

In another exemplary embodiment of a method of traversing and threading a paper web, including the steps of providing a sidewall of an air threading chute, and a plurality of air nozzles, each the air nozzle having an air orifice and a nozzle housing, the nozzle housing configured as u-shaped having a first elongated sidewall, a second elongated sidewall, and a third curved sidewall formed continuous with the first elongated sidewall and the second elongated sidewall to form a channel having an open end opposite the third curved sidewall, the air orifice positioned centered in the channel and proximate a base of the third sidewall facing the open end, wherein the first elongated sidewall, the second elongated sidewall, and the third curved sidewall are configured having an arched top surface, the sidewall having the plurality of air nozzles positioned linearly there along the sidewall; rotating each the air nozzle to set a linear or optimal path for the web paper to traverse therethrough the air threading chute; and connecting each the air nozzle to a compressed air source to provide high velocity air to the air orifice.

A feature of the present disclosure may include a nozzle body that may vary in size and configuration length, width, and height, and may even span the entire width of the sidewall, top and bottom walls of the guide chute.

A feature of the present disclosure may include a nozzle orifice or aperture that may vary in size and configuration, may include considerable orifice depth therein the nozzle body, and may be positioned in a trailing side of the nozzle body valley.

A feature of the present disclosure may include a nozzle body with a smooth surface to reduce or prevent tearing, snapping, or shredding of the paper web WP.

A feature of the present disclosure may include a nozzle body with a curved or angled surface to reduce or prevent tearing, snapping, or shredding of the paper web WP.

A feature of the present disclosure may include a nozzle body with an interior height or depth therein a channel to position the nozzle orifice and its high velocity air exiting therefrom away from paper web WP to reduce or prevent tearing, snapping, or shredding of the paper web WP.

A feature of the present disclosure may include configuring a nozzle body and nozzle orifice to enhance the Bernoulli Theorem and Coanda effect.

A feature of the present disclosure may include providing a novel nozzle body configuration and aperture to generate an optimal Coanda effect in a chute to guide a small continuous section of the paper sheet through the guide chute while holding the paper sheet flat, keeping the paper sheet within the guide chutes during the tail feed process, to prevent damage to the paper sheet as it is fed though the chutes, while using less compressed air consumption to perform the task.

A feature of the present disclosure may include providing a nozzle body that may be configured in a variety of shapes and sizes provided it includes a rounded nose, sloped or curved or pointed end with adjacent rim extension arms extending therefrom the nose to form a valley therebetween the adjacent rim extension arms to create an air chute to direct compressed air escaping from an aperture positioned on the backside of the rounded nose opening up to the valley confined and directed by adjacent rim extensions arms, the aperture connected thereto compressed air source, positioned in line with airflow therethrough the guide chute, to push air flow along the back wall of the guide chute to create a low pressure area proximate, around, above nozzle body.

A feature of the present disclosure may include configuring a nozzle body that functions to be turnable or rotatable about the sidewall of the chute to optimize or manipulate the direction and velocity of the paper web WP traversing the chute and enable up and down directional airflow to assist with guide chutes changes in elevation, turns, or transitions between guide chutes during the tail feed process.

A feature of the present disclosure may include configuring a nozzle body that functions to be removable or replaceable therefrom the sidewall of the chute to perform maintenance or to reposition nozzles therein the chute.

A feature of the present disclosure may include configuring a nozzle body that functions to be connected or quick connected thereto plant air supply or connected to a plenum to receive compressed air therefrom.

A feature of the present disclosure may include configuring a nozzle body configured as angled/rounded/square/rectangular or the like to provide or offer straighter air flow therethrough one or more threading chute and therefore provide improved guidance of the threading tail versus existing nozzle bodies.

These and other features of the web air threading system and methods of use will become more apparent to one skilled in the art from the prior Summary and following Brief Description of the Drawings, Detailed Description of exemplary embodiments thereof, and Claims when read in light of the accompanying Drawings or Figures.

BRIEF DESCRIPTION OF THE DRAWINGS

The present a web air threading system and methods of use will be better understood by reading the Detailed Description of the Preferred and Selected Alternate Embodiments with reference to the accompanying drawing Figures, in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1, 2A, 2B, 2C, 2D, 2E, 3A, 3C, 3D, 4A, 4B, 5, and 6 specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figure 1:
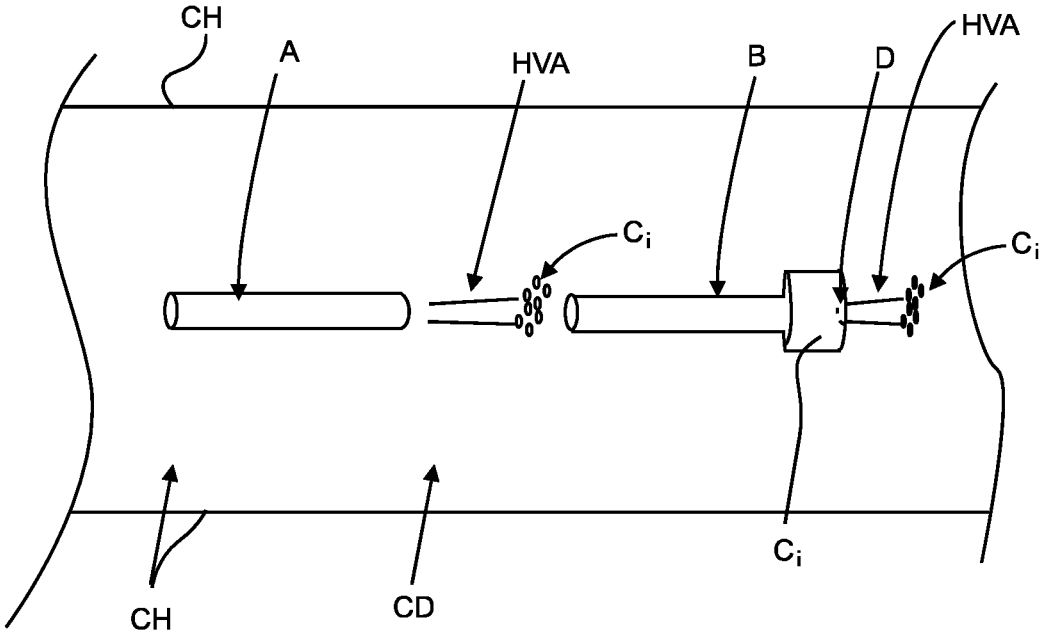
FIG. 1 is a perspective view of the a prior art web air threading system.
Figure 2A:
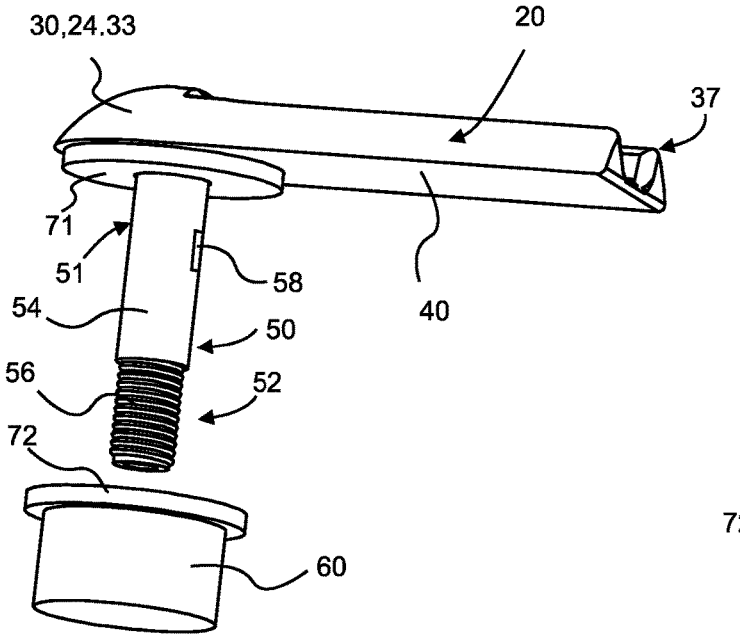
FIG. 2A is a perspective view of the a single web air threading nozzle according to select embodiments of the instant disclosure.
Figure 2D:
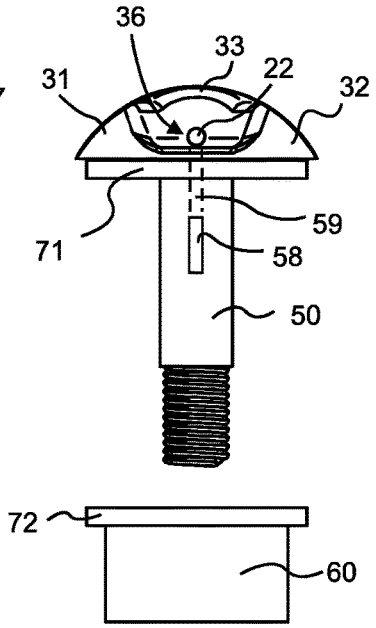
FIG. 2D is a front view of the a single web air threading nozzle according to select embodiments of the instant disclosure.
Figure 2B:
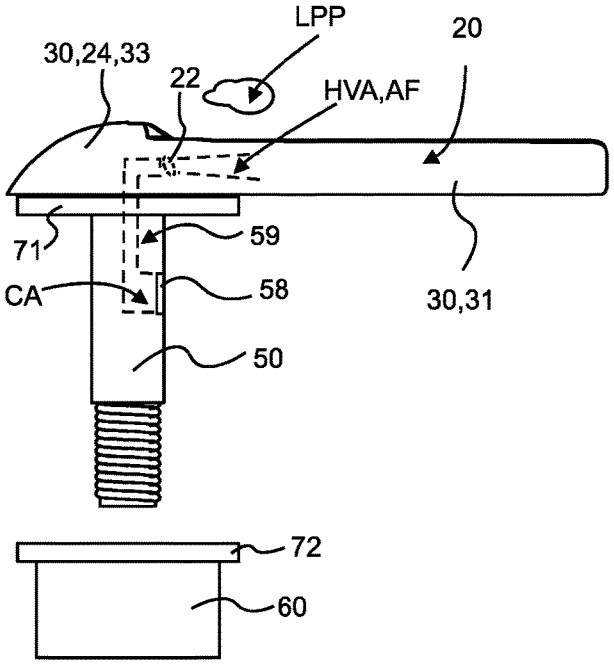
FIG. 2B is a side view of the a single web air threading nozzle according to select embodiments of the instant disclosure.
Figure 2C:
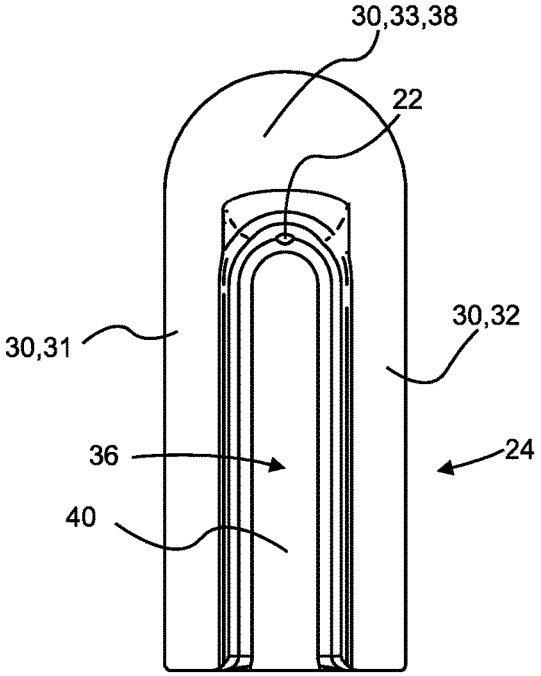
FIG. 2C is a top view of the a single web air threading nozzle according to select embodiments of the instant disclosure.
Figure 2E:
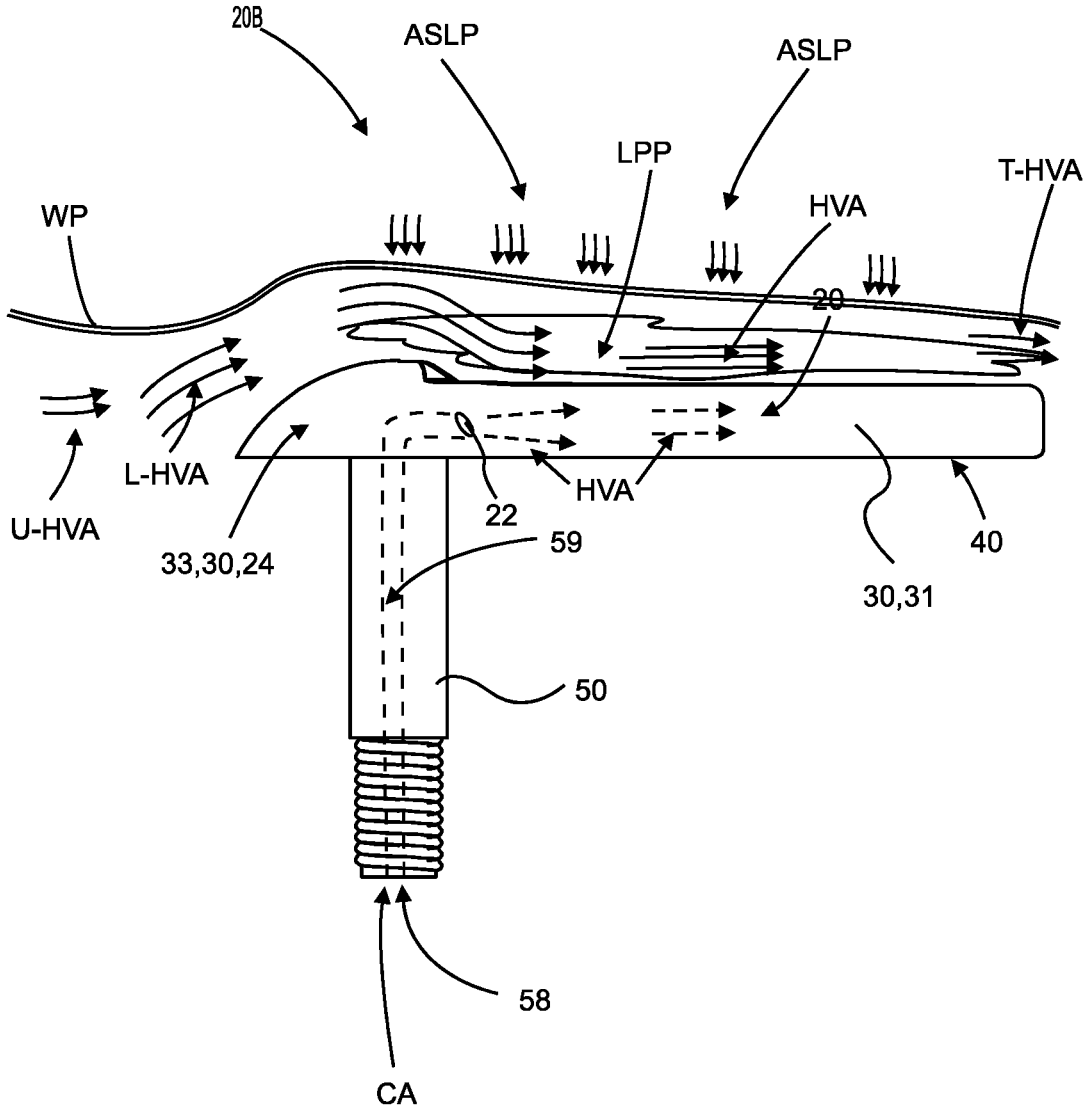
FIG. 2E is a side view of the a single web air threading nozzle showing air current directing paper web according to select embodiments of the instant disclosure.

Referring now to FIG. 1, a perspective view of the a prior art web air threading system showing an air nozzle protruding through a back wall or sidewall of a chute CH, such as ⅛ inch tubing A or larger sized pipe B with an end cap C and a small aperture D therein are inserted proximate the back wall or sidewall of the chute and bent to exhaust compressed air in the direction of the flow of the paper web WP. One disadvantage or drawback to these approaches is that, these air threading systems pull the fibrous web, such as paper web WP, such as retail tissue including toilet paper, napkins, paper towels and the like, into the highest velocity air HVA due to the pulling effect on the paper web WP of the low pressure due to the Coanda effect/Bernoulli principle causing the air stream to tear, snap, or shred the paper web WP like confetti Ci.

Referring now to FIGS. 2A, 2B, 2C, 2D, and 2E by way of example, and not limitation, there is illustrated an example embodiment of air nozzle 20, according to this select embodiment. Air nozzle 20 is preferably configured with raised curved nozzle body or surface, such as nozzle housing 30 surrounding air orifice 22 in side directions other than the direction of air flow AF exiting air orifice 22. In an exemplary embodiment, air nozzle 20 may include u-shaped housing 24 (resembling a broad U in cross profile a U-shaped valley) surrounding air orifice 22. U-shaped housing 24 preferably may an arched, elongated, raised, or curved surface left or first sidewall 31, an arched, elongated, raised, or curved surface right or second sidewall 32, and an arched, raised, curved, angled or curved back or third sidewall 33 (third curved sidewall) formed together or continuous (connected together to form an unbroken sequence) with first sidewall 31 and second sidewall 32 in a u-shaped pattern to form u-shaped housing 24 having channel 36 with an open end 37 opposite third sidewall 33, together positioned therearound air orifice 22. U-shaped housing 24 may include arched or curved top surface 38 to enable smooth airflow over U-shaped housing 24. U-shaped housing 24 may be positioned thereon and integral to base 40 wherein base 40 spans between first sidewall 31 and second sidewall 32 beneath channel 36. It is contemplated herein that base 40 may not be present and that air nozzle 20 may be affixed thereto a guide chute, such as air threading chute 10 where air threading chute 10 forms a base for air nozzle 20. Air orifice 22 is preferably positioned proximate a center or focal point location where base 40 and third sidewall 33, first sidewall 31, and second sidewall 32 connect or join, or proximate where air threading chute 10 and third sidewall 33 meet or positioned therein third sidewall 33 and centered therein channel 36. Moreover, base 40, third sidewall 33, first sidewall 31, and second sidewall 32 form an open ended canal or trough, such as channel 36 around air orifice 22. Air orifice 22 is preferably positioned therethrough third sidewall 33 into channel 36 proximate base 40 between ¼" inch to 1" inch below top surface 38 of u-shaped housing 24 to prevent web paper WP from coming into contact with highest velocity air HVA exiting air orifice 22. It is contemplated herein that air orifice 22 is may be positioned other distances below top surface 38 of u-shaped housing 24 to prevent web paper WP from coming into contact with highest velocity air HVA exiting air orifice 22. It is recognized herein that housing 24, specifically third sidewall 33 may be raised or lowered to increase or decrease the Coanda effect/Bernoulli principle. It is further recognized herein that housing 24, specifically, first sidewall 31 and second sidewall 32 may be shortened or lengthened to increase or decrease the Coanda effect/Bernoulli principle.

Preferably, a cross-section of u-shaped housing 24 may be configured as an arc, arch, curved, dome shaped or other like configuration to reduce all sharp edges and surface transitions of air nozzle 20 to enable a medium, such as paper web WP to glide across its surface. Moreover, raised curved ridge housing 24 and its raised left or first sidewall 31, raised right or second sidewall 32, and raised back or third sidewall 33 relative to base 40 or air threading chute 10 may create a height differential or buffer relative to air orifice 22 to protect paper web WP from highest velocity air HVA exiting air orifice 22.

It is contemplated herein that air nozzle 20 may vary in size and configuration length, width, and height, and may even span the entire width of chute sidewall 11 of air threading chute 10. Moreover, air nozzle 20 may be configured as v-shaped, open ended square or rectangle, arcing, parabolic, rounded, semi-circle, or other like open end configuration, channel, or trough, such as channel 36 to funnel or direct air flow AF exiting air orifice 22.

It is further contemplated herein that air orifice 22 aperture may vary in size and configuration. Moreover, air orifice 22 may be configured as round, slotted, oval, square, rectangular, oblong, slit, or as a combination of smaller holes, slits, or apertures, or other like aperture configurations. Air orifice 22 may be positioned proximate base 40 or chute sidewall 11 of air threading chute 10 to project air parallel to base 40 or chute sidewall 11 of air threading chute 10 to provide or offer straighter air flow therethrough one or more threading chute and therefore provide improved guidance of paper web WP versus prior art.

Furthermore, air nozzle 20 may include connector stem 50 to mount air nozzle 20 to a plenum or conduit distributing compressed air via a compressed air system to air orifice 22 of air nozzle 20. Connector stem 50 may include first stem end 51 which may be affixed to an underside of third sidewall 33 or base 40 proximate third sidewall 33 and preferably positioned under or proximate air orifice 22. Connector stem 50 may include second stem end 52 being threaded 56 to receive or fit threaded attachment device, such as nut 60 to affix air nozzle 20 to third sidewall 33. It is contemplated herein that connector stem 50 may utilize one or more sealing gasket, such as first flexible washer 71 and second flexible washer 72. First flexible washer 71 may be utilized to air seal base 40 to one side of a plenum and second flexible washer 72 may be utilized to air seal nut 60 to another side of a plenum.

It is recognized herein that connector stem 50 may include a passageway, such as connector aperture 58 positioned therein connector stem 50. Connector aperture 58 may be connected to air orifice 22 via conduit 59 (having a first conduit end and a second conduit end) traversing or formed therein connector stem 50. Conduit 59 having a first conduit end and a second conduit end connects compressed air CA (via a compressed air system) entering connector aperture 58, traversing conduit 59 to discharge therefrom air orifice 22.

Referring again to FIG. 2E by way of example, and not limitation, there is illustrated an example embodiment of air nozzle 20B without first flexible washer 71, second flexible washer 72, nut 60, according to an alternate embodiment. Air nozzle 20B may be connected to compressed air CA via house or plant air from a remote air compressor or the like. It is recognized herein that connector stem 50 may include a passageway, such as connector aperture 58 positioned therein second stem end 52 of connector stem 50. Connector aperture 58 may be connected to air orifice 22 via conduit 59. Conduit 59 connects compressed air CA entering connector aperture 58, traversing conduit 59 to discharge therefrom air orifice 22.

It is contemplated herein that air nozzle 20 may not include raised left or first sidewall 31, raised right or second sidewall 32 and end with curved sidewall 33, wherein top surface 38 of curved sidewall 33 may also be configured as slanted, angled, rounded, sloped, arc, curved, dome shaped or other like configuration to reduce all sharp edges and surface transitions of air nozzle 120 to enable a medium, such as paper web P to glide across its leading edge surface.

Moreover, in use upstream and current air nozzle 20/20B upstream high velocity air U-HVA (from an upstream air nozzle 20/20B) and high velocity air HVA (from current air nozzle 20/20B) linearly propel or carry paper web WP along a series of air nozzles 20/20B. Leading edge high velocity air L-HVA may be deflected upward from a plane parallel to base 40 by smooth arcing third sidewall 33 to lift paper web WP above and away from high velocity air HVA exiting air orifice 22. The pulling effect of air currents seeking low pressure ASLP of low pressure pocket LPP on paper web WP due to the Coanda effect/Bernoulli principle of air nozzle 20/20B pulls deflected leading edge high velocity air L-HVA and paper web WP close to or proximate a plane parallel to the top surface of raised curved ridge housings 24 of air nozzle 20/20B. Furthermore, the pulling effect of air currents seeking low pressure ASLP of low pressure pocket LPP on paper web WP due to the Coanda effect/Bernoulli principle of air nozzle 20/20B pulls trailing edge high velocity air T-HVA and paper web WP close to or proximate a plane parallel to base 40. High velocity air HVA from air nozzle 20/20B propels paper web WP to the next downstream air nozzle 20/20B to repeat and further linearly propel or carry paper web WP along a series of air nozzles 20/20B.

Figure 3C:
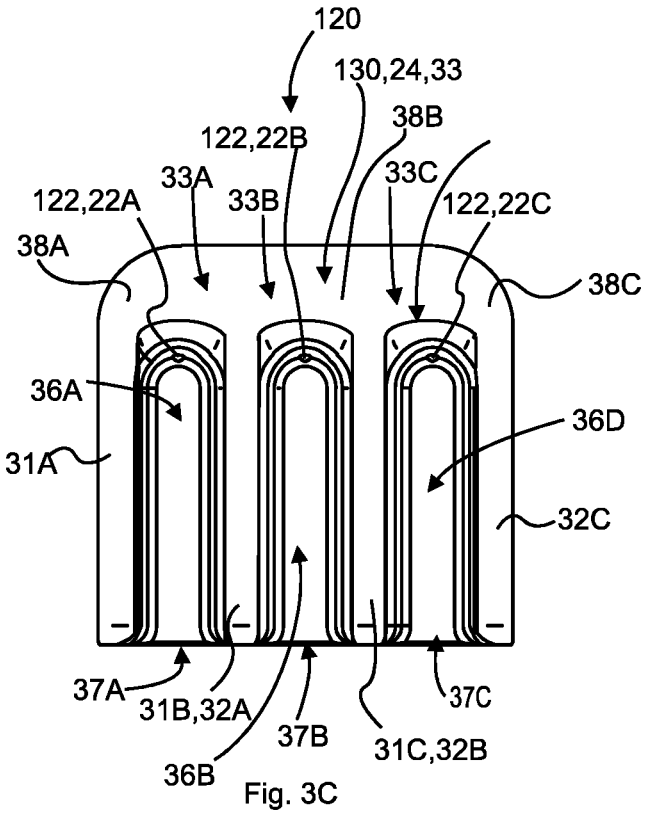
FIG. 3C is a top view of the a triplet web air threading nozzle according to select embodiments of the instant disclosure.
Figure 3D:
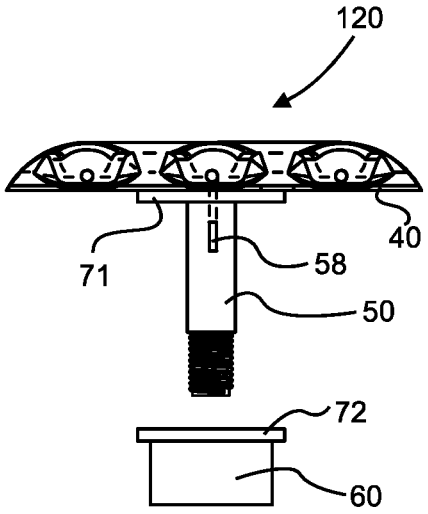
FIG. 3D is a front view of the a triplet web air threading nozzle according to select embodiments of the instant disclosure.
Figure 3A:
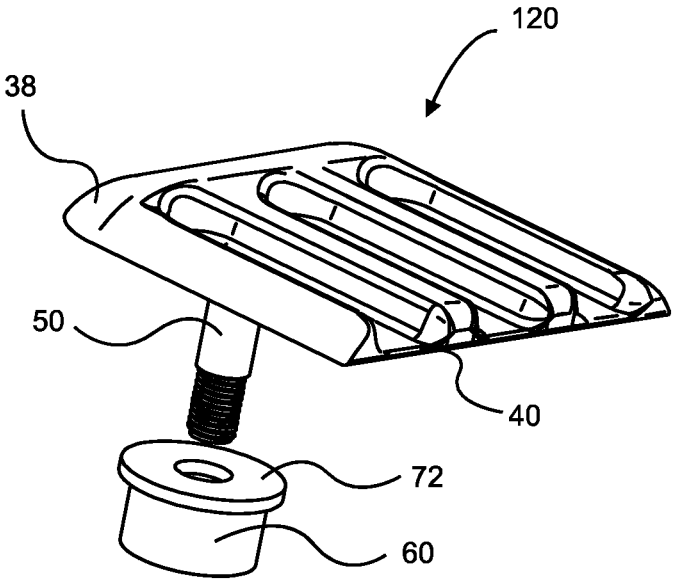
FIG. 3A is a perspective view of the a triplet web air threading nozzle according to select embodiments of the instant disclosure.

Referring now to FIGS. 3A, 3C, and 3D by way of example, and not limitation, there is illustrated an example embodiment of air nozzle 120, according to this select embodiment. Each of air nozzle 120 is preferably configured with a plurality of raised curved surfaces 130 (each a raised curved surfaces 30) surrounding one of a plurality of air orifice 122 (each an air orifice 22) in side directions other than the direction of air flow AF exiting each air orifice 22. In an exemplary embodiment, air nozzle 120 may include a plurality of u-shaped(es), such as a plurality of u-shaped housings 24 one of the each housing surrounding each air orifice 22 of plurality of air orifice 122. Plurality of raised curved surfaces 130 may include a series of U-shaped housings 24A, 24B (center), 24C and each U-shaped housing 24A, 24B, 24C may include an arched, elongated, raised, or curved left or first sidewall 31A, 31B, 31C, an arched, elongated, raised, or curved right or second sidewall 32A, 32B, 32C, and an arched, raised, curved and angled, or curved back or third sidewall 33A, 33B, 33C formed together continuous with each or first sidewall 31A, 31B, 31C and second sidewall 32A, 32B, 32C to form the plurality of u-shaped raised curved ridge 24A, 24B, 24C channel 36A, 36B, 36C with an open end 37A, 37B, 37C opposite third sidewall 33A, 33B, 33C, together positioned around air orifice 22A, 22B, 22C. U-shaped housing 24A, 24B, 24C may include arched or curved top surface 38A, 38B, 38C to enable smooth airflow over U-shaped housing 24. U-shaped housing 24 may be positioned thereon and integral to base 40 wherein base 40 spans between first sidewall 31A, 31B, 31C and second sidewall 32A, 32B, 32C beneath channel 36A, 36B, 36C, respectively. It is contemplated herein that base 40 may not be present and that air nozzle 120 may be affixed thereto air threading chute 10 where air threading chute 10 forms a base for air nozzle 120. Each of plurality of air orifice 122, air orifice 22A, 22B, 22C is preferably positioned proximate a center or focal point location where base 40 and third sidewall 33A, 33B, 33C connect or join, or proximate where air threading chute 10 and third sidewall 33A, 33B, 33C meet or positioned therein third sidewall 33A, 33B, 33C and centered therein channel 36A, 36B, 36C. Moreover, base 40, and each third sidewall 33, each first sidewall 31, and each second sidewall 32 form an open ended canal or trough, such as channel 36A, 36B, 36C around orifice 22A, 22B, 22C. Preferably, a cross-section of u-shaped housing 24 may be configured as an arc, arched, curved, dome shaped or other like configuration to reduce all sharp edges and surface transitions of air nozzle 120 to enable a medium, such as paper web WP to glide across its surface. Moreover, each raised curved ridge housing 24A, 24B, 24C and its raised left or first sidewall 31, raised right or second sidewall 32, and raised back or third sidewall 33 relative to base 40 or air threading chute 10 may create a height differential or buffer relative to air orifice 122 to protect paper web WP from highest velocity air HVA exiting and air orifice 22.

It is contemplated herein that air nozzle 120 may vary in size and configuration length, width, and height, number of orifices 22 and channels 36, and may even span the entire width of chute sidewall 11 of air threading chute 10. Moreover, air nozzle 120 may be configured as v-shaped, open ended square or rectangle, arcing, parabolic, semi-circle, or other like open end configuration, channel, or trough, such as channel 36 to funnel or direct air flow AF exiting air orifice 22.

It is further contemplated herein that air orifice 22 apertures may vary in size and configuration. Moreover, air orifice 22 may be configured as round, slotted, oval, square, rectangular, oblong, or as a combination of smaller holes or apertures, or other like aperture configurations. Air orifice 22 may be positioned proximate base 40 or chute sidewall 11 of air threading chute 10 to project air parallel to base 40 or chute sidewall 11 of air threading chute 10.

Furthermore, air nozzle 120 may include one or more connector stem 50 to mount air nozzle 20 to a plenum or conduit distributing compressed air to air orifice 22 of air nozzle 120. Connector stem 50 may include first stem end 51 which may be affixed to base 40 proximate third sidewall 33 end and preferably positioned under or proximate air orifice 22. Connector stem 50 may include second stem end 52 being threaded 56 to receive threaded attachment device, such as nut 60. It is contemplated herein that connector stem 50 may utilize one or more sealing gasket, such as first flexible washer 71 and second flexible washer 72. First flexible washer 71 may be utilized to air seal base 40 to one side of a plenum and second flexible washer 72 may be utilized to air seal nut 60 to another side of a plenum.

It is recognized herein that connector stem 50 may include a passageway, such as connector aperture 58 positioned proximate first stem end 51 of connector stem 50. Connector aperture 58 may be connected to air orifice 22 via conduit 59 traversing connector stem 50 from connector aperture through first stem end 51 to air orifice 22. Conduit 59 connects compressed air CA entering connector aperture 58, traversing conduit 59 to discharge therefrom air orifice 22.

Referring again to FIG. 3 by way of example, and not limitation, example embodiment of air nozzle 120B may be utilized without first flexible washer 71, second flexible washer 72, nut 60, according to an alternate embodiment. Air nozzle 120B may be connected to compressed air CA via house or plant air from a remote air compressor, air supply or distribution or the like similar to FIG. 2E.

Figure 4A:
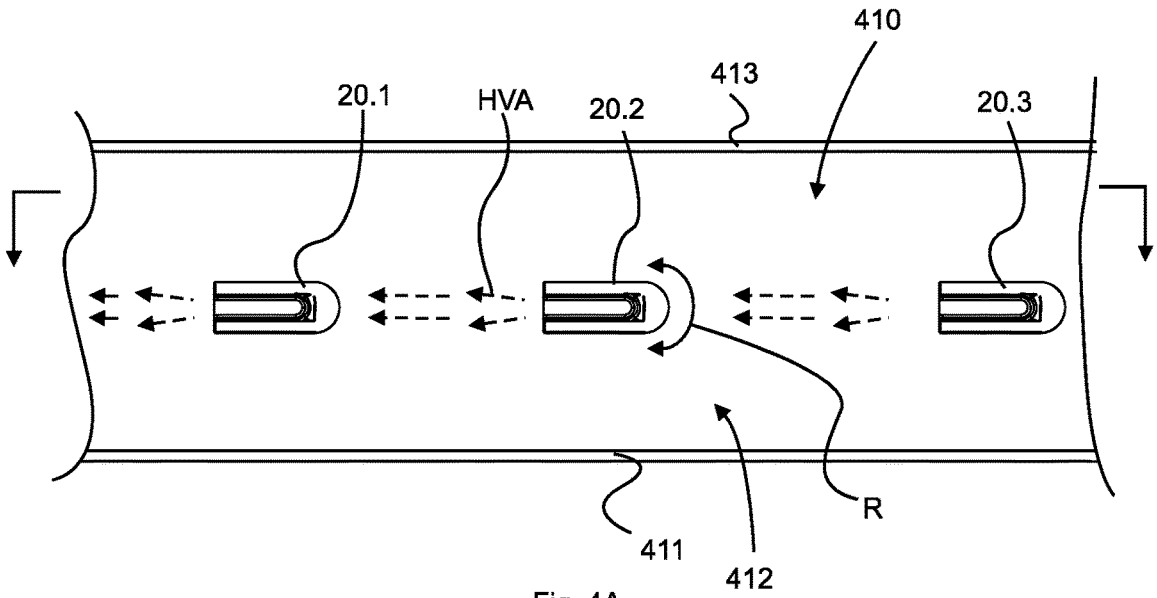
FIG. 4A is a side view of a chute with a series of a single web air threading nozzles of FIG. 2 positioned against a back wall of the chute according to select embodiments of the instant disclosure.
Figure 4B:
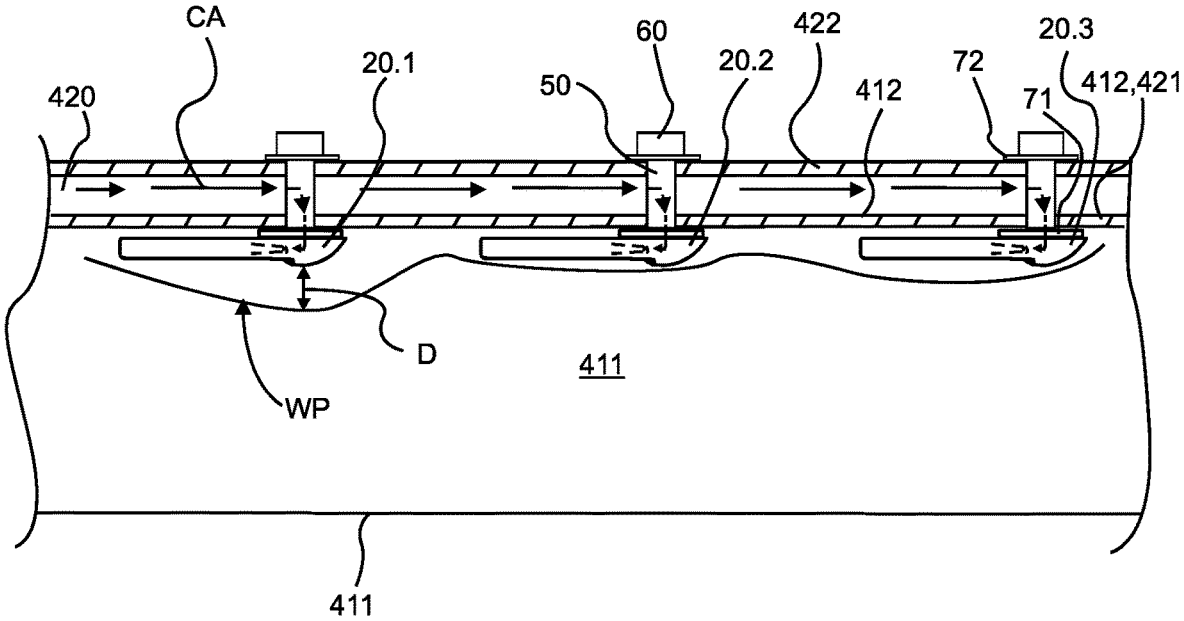
FIG. 4B is a cross sectional top view the chute of FIG. 4A with a series of a single web air threading nozzles of FIG. 2 positioned against a back wall of the chute according to select embodiments of the instant disclosure.

Referring now to FIGS. 4A and 4B, by way of example, and not limitation, there is illustrated a side view of an example embodiment of a section of air threading chute 410 having plurality of air nozzles 20 positioned therein air threading chute 410. Air threading chute 410 may include two or more sides (sidewall), such as chute backside 412, chute bottom side 413, and chute topside 411 to create a wind tunnel to propel paper web WP therein. It is recognized herein that air threading chute 410 may include flared edges or angled edges to partially encapsulate paper web WP therein. Plurality of air nozzles 20 may include curvilinear or linear (linear) placement of spaced air nozzles 20, such as first air nozzles 20.1, second air nozzles 20.2, and third air nozzles 20.3 positioned against preferably chute backside 412 with air orifice 22 pointing toward exit end of air threading chute 410, but may alternatively be positioned on chute bottom side 413 or chute topside 411 depending on the orientation of paper web WP. It is recognized herein that air nozzles 20 may be rotated R about connector stem 50 to orient high velocity air HVA relative to backside 412, chute bottom side 413, and chute topside 411 to direct the travel of paper web WP in a variety of directions.

Referring again to FIG. 4B, by way of example, and not limitation, there is illustrated a cross sectional view of example embodiment of a section of air threading chute 10, 410 of FIG. 4A having plurality of air nozzles 20 positioned therein a section of air threading chute 410. Spaced air nozzles 20, such as first air nozzles 20.1, second air nozzles 20.2, and third air nozzles 20.3 are configured with connector stem 50 inserted through backside 412 and plenum housing 420 with flexible washer 71 utilized to air seal base 40 to chute backside 412 or first plenum side 421 and second flexible washer 72 may be utilized to air seal nut 60 to second plenum side 422 of plenum 420. Compressed air CA may be utilized to fill plenum 420 and plenum 420 may be utilized to deliver compressed air CA to air nozzles 20, such as first air nozzles 20.1, second air nozzles 20.2, and third air nozzles 20.3. It is recognized herein that plenum 420 and air nozzles 20 may be configured as a box or unit to be affixed to air threading chute 10, 410. Each air nozzles 20 may receive compressed air from plenum 420 by compressed air CA entering connector aperture 58, traversing conduit 59 to discharge therefrom air orifice 22 as high velocity air HVA.

It is contemplated herein that compressed air CA may be controlled individually via tubing connected to connector stem 50 by control of compressed air CA or together within a section of air threading chute 10, 410 via control of compressed air CA in plenum 420.

Figure 5:
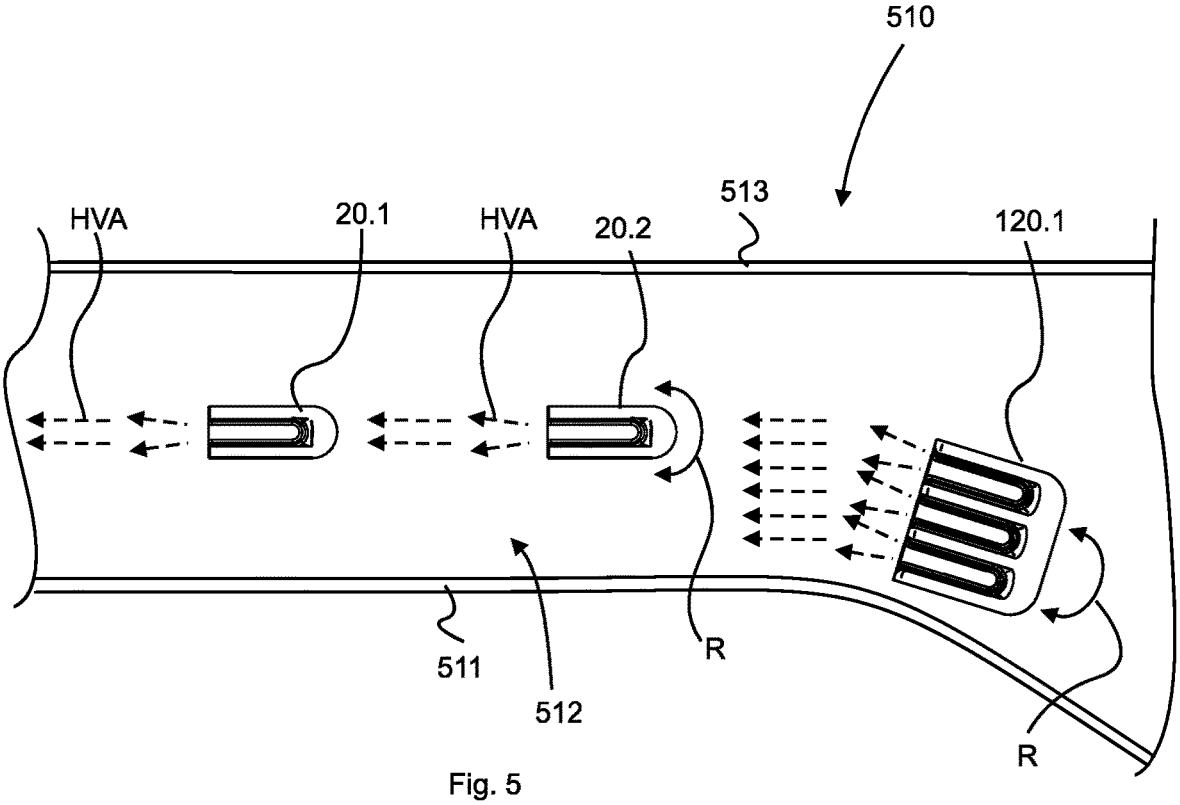
FIG. 5 is a side view of a chute with a single web air threading nozzle of FIG. 2 and a triplet air threading nozzle of FIG. 3 in series positioned against a back wall of the chute according to select embodiments of the instant disclosure.

Referring now to FIG. 5, by way of example, and not limitation, there is illustrated a side view of an example embodiment of a curved section of air threading chute 10, 510 having plurality of air nozzles 20/120 positioned therein curved air threading chute 510. Air threading chute 510 may include two or more sides, such as chute backside 512, curved or flared chute bottom side 513, and chute topside 511 to create a wind tunnel to propel paper web WP therein a curved or arcing Ar direction. It is recognized herein that air threading chute 510 may include flared edges or angled edges to partially encapsulate paper web WP therein. Plurality of air nozzles 20/120 may include linear placement of spaced air nozzles 20/120, such as first air nozzle 20.1, second air nozzle 20.2, and third air nozzle 120 positioned against preferably chute backside 512 with air orifice 122 pointing toward exit end of air threading chute 510, but may alternatively be positioned on chute bottom side 513 or chute topside 511 depending on the orientation of paper web WP. It is recognized herein that air nozzles 20/120 may be rotated R about connector stem 50 to orient high velocity air HVA relative to backside 512, chute bottom side 513, and chute topside 511 to direct the travel of paper web WP in a variety of directions, such as arcing Ar.

A cross section of FIG. 5, by way of example, and not limitation may be illustrated by FIG. 4B having plurality of air nozzles 20/120 positioned therein air threading chute 510.

It is contemplated herein that compressed air CA may be controlled individually via tubing connected to connector stem 50 and control of compressed air CA or together within a section of air threading chute 10, 510 via control of compressed air CA in plenum 420.

It is contemplated herein that air nozzles 20/120 components may be constructed of stainless steel, aluminum, or the like materials and of different dimensions. This and other materials herein may be constructed of metal, steel, alloy, or plastic or more specifically high density polyethylene or similar high tensile or strengthened materials, as these material offers a variety of forms and shapes and provide strength with reduced weight; however, other suitable materials or the like, can be utilized, provided such material has sufficient strength and/or durability as would meet the purpose described herein to enable air nozzles 20/120 to discharge high velocity air HVA to float or carry paper web WP therein air threading chute 10/510.

It is contemplated herein that air nozzles 20/120 may be positioned anywhere on backside 412/512, chute top side 413/513, and chute bottom side 411/511 top, bottom, middle or other position of side or cover the whole side.

It is understood herein that various changes in the material used, shape, size, arrangement of parts, and parts are connected with bolts, pins, screws or similar fasteners or other rotating devices without departing from the spirit of the scope of the claims herein.

It is further understood herein that the parts and elements of this disclosure may be located or position elsewhere based on one of ordinary skill in the art without deviating from the present disclosure.

Figure 6:
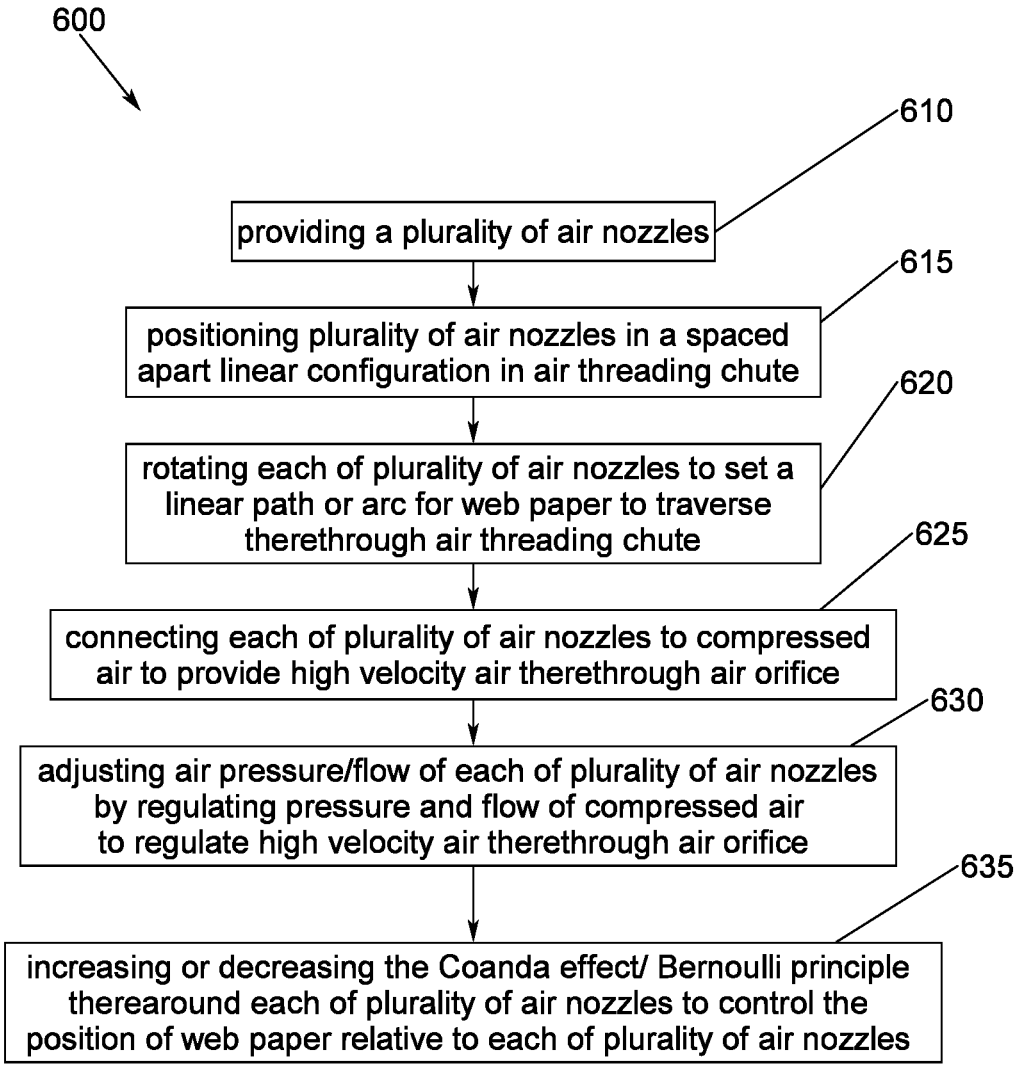
FIG. 6 is a flow diagram depicting operation and use of air threading nozzle therein air threading chute to mobilize web paper.

Referring now to FIG. 6, there is illustrated a flow diagram 600 of a method of traversing paper web P through air threading chute 10. In block or step 610, providing a plurality of air nozzles 20/120, as described above in FIGS. 1-5, to propel or carry web paper WP in air threading chute 10/410/510. In block or step 615, positioning plurality of air nozzles 20/120 in a spaced apart curvilinear or linear (both linearly) configuration in air threading chute 10/410/510. In block or step 620, rotating each of plurality of air nozzles

20/120 in a spaced apart linear configuration in air threading chute 10/410/510 to set an optimal linear path or arc or centered therein for web paper WP to traverse therethrough air threading chute 10/410/510. In block or step 625, connecting each of plurality of air nozzles 20/120 to compressed air CA to provide high velocity air HAV therethrough air orifice 22/122. In block or step 630, adjusting air pressure/flow of each of plurality of air nozzles 20/120 by regulating pressure and flow of compressed air CA to regulate high velocity air HAV therethrough air orifice 22/122 to increase or decrease the speed (regulate) of web paper WP relative to each of plurality of air nozzles 20/120 and, thus in block or step 635, increasing or decreasing (regulate) the Coanda effect/Bernoulli principle therearound each of plurality of air nozzles 20/120 to control distance D (regulate) between the position of web paper WP relative to each of plurality of air nozzles 20/120.

With respect to the above description then, it is to be realized that the optimum dimensional relationships, to include variations in size, materials, shape, form, position, movement mechanisms, function and manner of operation, assembly and use, are intended to be encompassed by the present disclosure.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Moreover, the present disclosure has been described in detail, it should be understood that various changes, substitutions and alterations can be made thereto without departing from the spirit and scope of the disclosure as defined by the appended claims. Accordingly, the present disclosure is not limited to the specific embodiments illustrated herein but is limited only by the following claims.

The invention claimed is:

1. An air nozzle apparatus configured to enable a paper web to be pulled to and glide across its surface via a high velocity airstream, said apparatus comprising a nozzle housing, said nozzle housing configured as u-shaped having a first elongated sidewall, a second elongated sidewall configured parallel to said first elongated side wall, and a third curved sidewall formed continuous with said first elongated sidewall and said second elongated sidewall to form an open end u-shaped valley therein said nozzle housing having said open end opposite said third curved sidewall; and an air orifice to release the high velocity airstream, said air orifice positioned in said third curved sidewall and proximate a base of said open end u-shaped valley facing said open end, wherein said open end u-shaped valley is configured to protect the paper web from the high velocity airstream.

2. The apparatus of claim 1, wherein the high velocity airstream creates a low pressure pocket proximate said base to pull the paper web against said first elongated sidewall, said second elongated sidewall, and said third curved sidewall.

3. The apparatus of claim 1, further comprising a connector stem having a first stem end and a second stem end, wherein said first stem end is connected to an underside of said third curved sidewall proximate said air orifice.

4. The apparatus of claim 3, wherein said connector stem further comprising a connector aperture connected to a first conduit end of a conduit formed therein said connector stem and a second conduit end of said conduit connected to said air orifice.

5. The apparatus of claim 3, wherein said second stem end is threaded.

6. The apparatus of claim 1, wherein said air orifice is positioned centered in said third curved sidewall.

7. An air nozzle apparatus configured to enable a paper web to be pulled to and glide across its surface via a high velocity airstream, said apparatus comprising:

a nozzle housing, said nozzle housing configured having a plurality of u-shaped housings, each u-shaped housing having a first elongated sidewall, a second elongated sidewall configured parallel to said first elongated side wall, and a third curved sidewall formed continuous with said first elongated sidewall and said second elongated sidewall to form an open end u-shaped valley therein said nozzle housing having said open end opposite said third curved sidewall, said each u-shaped housing having an air orifice to release the high velocity airstream, said orifice positioned in said third curved sidewall and proximate a base of said open end u-shaped valley facing said open end, wherein each said open end u-shaped valley is configured to protect the paper web from the high velocity airstream.

8. The apparatus of claim 7, wherein the high velocity airstream creates a low pressure pocket proximate said base to pull the paper web against said first elongated sidewall, said second elongated sidewall, and said third curved sidewall.

9. The apparatus of claim 7, further comprising a connector stem having a first stem end and a second stem end, wherein said first stem end is connected to an underside of said third curved sidewall proximate said air orifice of a center said plurality of u-shaped housings.

10. The apparatus of claim 9, wherein said connector stem further comprising a connector aperture connected to a first conduit end of a conduit formed therein said connector stem and a second conduit end of said conduit connected to said air orifice in said plurality of u-shaped housings.

11. The apparatus of claim 9, wherein said second stem end is threaded.

12. The apparatus of claim 7, wherein said air orifice is positioned centered in said third curved sidewall.

* * * * *